US006857822B2

(12) United States Patent
Hooper et al.

(10) Patent No.: US 6,857,822 B2
(45) Date of Patent: Feb. 22, 2005

(54) RISER SYSTEM EMPLOYING A TENSIONING MECHANISM

(75) Inventors: Alan Gregory Hooper, Singapore (SG); Geir Eik, Elmira Heights (SG); Yves De Leeneer, Singapore (SG)

(73) Assignee: Prosafe Production Pte, Ltd., The Synergy (SG)

( * ) Notice: Subject to any disclaimer, the term of this patent is extended or adjusted under 35 U.S.C. 154(b) by 13 days.

(21) Appl. No.: 10/277,103

(22) Filed: Oct. 22, 2002

(65) Prior Publication Data

US 2003/0086763 A1 May 8, 2003

Related U.S. Application Data

(60) Provisional application No. 60/330,500, filed on Oct. 23, 2001.

(51) Int. Cl.[7] ..... E21B 43/013

(52) U.S. Cl. ..... 405/224.4; 405/224; 166/355

(58) Field of Search ..... 405/224.2, 224.3, 405/224.4, 177, 170, 169; 166/350, 375, 351, 352, 353, 354, 355, 367; 471/3, 9, 5

(56) References Cited

U.S. PATENT DOCUMENTS

| | | | | | |
|---|---|---|---|---|---|
| 3,834,432 | A | * | 9/1974 | Lilly et al. | 441/4 |
| 3,883,912 | A | * | 5/1975 | Pedersen | 441/5 |
| 3,953,982 | A | * | 5/1976 | Pennock | 405/168.1 |
| 4,546,721 | A | * | 10/1985 | Langrock | 441/4 |
| 4,669,412 | A | * | 6/1987 | Pollack | 441/5 |
| 4,793,737 | A | * | 12/1988 | Shotbolt | 405/169 |
| 4,906,137 | A | * | 3/1990 | Maloberti et al. | 405/224.3 |

* cited by examiner

*Primary Examiner*—Frederick L. Lagman
(74) *Attorney, Agent, or Firm*—Jones, Tullar & Cooper PC

(57) ABSTRACT

A riser system for use in transporting fluid cargo to a floating vessel from a submerged pipe employs a tensioning mechanism that prevents excess slack in a flexible riser that could potentially damage the riser. The tensioning mechanism includes a tensioning arm or element that is pivotally attached at a first end to a submerged base and at its second end to the flexible riser. The arm is free to rotate about the pivot point in a pendulum manner, but is urged toward an equilibrium position by one or more tension-applying elements disposed on the arm, such as a buoyancy element, a weight or both.

24 Claims, 4 Drawing Sheets

RISER SYSTEM EMPLOYING A TENSIONING MECHANISM

CROSS REFERENCE TO RELATED APPLICATIONS

This application claims priority, under 35 USC 119(e), on U.S. Provisional Application No. 60/330,500, which was filed on Oct. 23, 2001.

BACKGROUND OF THE INVENTION

1. Field of the Invention

The present invention relates, in general, to a riser system of the type that is typically employed with offshore facilities for transferring fluids, such as oil or gas, from sub sea pipes to a floating tanker vessel that is secured to a single point mooring. The riser system includes a tensioning mechanism that enables the riser to move an amount that is sufficient to accommodate movement of the vessel under extreme conditions or in relatively shallow water, while automatically taking up excess slack that could otherwise damage the riser system.

2. Description of the Related Art

Seagoing vessels often cannot be accommodated in conventional harbors due to the size of the vessel, the capacity of the harbor or for other reasons. In those instances where a conventional mooring is impossible or unavailable, offshore mooring systems must be employed. In situations involving tanker vessels for transporting fluid cargo, systems have been developed wherein a vessel is moored at sea in relatively deep water using what is known as a single point mooring. Associated with the mooring is a riser system that facilitates transfer of the fluid cargo between the vessel and onshore facilities through underwater pipelines. The specific fluid carrying lines that ascend from the sea floor to a vessel are known as risers.

In order to provide sufficient flexibility to allow for the movement of the vessel or single point mooring in response to wave and wind action, the risers are typically made of flexible unbonded steel pipes, hoses or combinations of both, and are usually disposed in catenary type arrangements. Such systems require a minimum length of the riser in order to provide sufficient scope to cover the full range of movements of the vessel. In many applications, this is not possible due to the need to keep the riser clear of the seabed and vessel. In particular, if the riser is made long enough to accommodate a large degree of movement of the vessel, as may occur during extreme weather conditions, then during normal conditions, the extra length of riser will create so much slack therein that the riser will likely contact either the seabed or the vessel, thus potentially damaging the riser. Similarly, in shallow water conditions, even a normal amount of slack in the riser can cause potentially damaging contact of the riser with the seabed.

Therefore, there has been a long felt need for a riser system that is capable of providing a sufficient degree of movement to accommodate vessel movement in extreme conditions or shallow water conditions, but at the same time prevents the generation of excessive slack in the riser that could cause damage thereto.

SUMMARY OF THE INVENTION

The present invention comprises a riser system that fulfills the foregoing need through provision of a tensioning mechanism that allows the riser to accommodate substantial movement of a moored vessel during extreme weather conditions, for example, but automatically takes in excess slack in the riser during normal conditions. The same feature enables a flexible riser to be employed in shallow water conditions that would normally result in potentially damaging contact between the riser and the seabed. To provide this functionality, the riser tensioning mechanism includes a tensioning element, such as a rigid arm, that is mounted at a first end by means of one or more pivot connections to a submerged base or other suitable structure. The riser is secured at a second end of the tensioning element.

The tensioning element includes one or more elements, such as a weight, buoyancy element or both, for applying a tensioning force to the tensioning element and thereby to the riser. In operation, the tensioning element rotates about the pivot point of the pivot connection(s) in a pendulum manner in response to forces imparted to the riser by movement of the vessel to which the riser is attached. The tension applying elements act to urge or restore the tensioning element to an equilibrium or rest position. In this manner, the tensioning mechanism insures that excess slack in the riser is taken up during normal weather conditions, for example, but still permits substantial movement of the vessel during extreme weather conditions. The weight can be positioned to one side of the tensioning element to urge the element to that side of vertical to and thereby provide a restoring force when the system is out of equilibrium. In embodiments employing a buoy or other buoyancy element, the buoyancy characteristics of the buoy creates a restoring effect that urges the tensioning element toward a vertical equilibrium position.

Preferably, the second end of the tensioning element includes a curved outer surface so that the riser can be wrapped around and secured to this surface to minimize any likelihood that he riser could be damaged by the tensioning element. The riser is preferably attached to the tensioning element by any suitable means, such as a clamp arrangement. As an alternative, the riser can be attached to the tensioning element by means of a second pivot, which allows greater flexibility of the connection between the riser and the tensioning element and aids in reducing loads in the riser. In addition, a short rigid section of pipe can replace the portion of the flexible riser that is to be secured to the tensioning element to eliminate the need to apply clamps or other securing elements to any portion of the flexible riser itself.

BRIEF DESCRIPTION OF THE SEVERAL VIEWS OF THE DRAWINGS

The foregoing, and additional objects, features, and advantages of the present invention will become apparent to those of skill in the art from the following detailed description of a number of preferred embodiments thereof, taken in conjunction with the accompanying drawings, in which.

DETAILED DESCRIPTION OF THE INVENTION

Figures 1, 2:
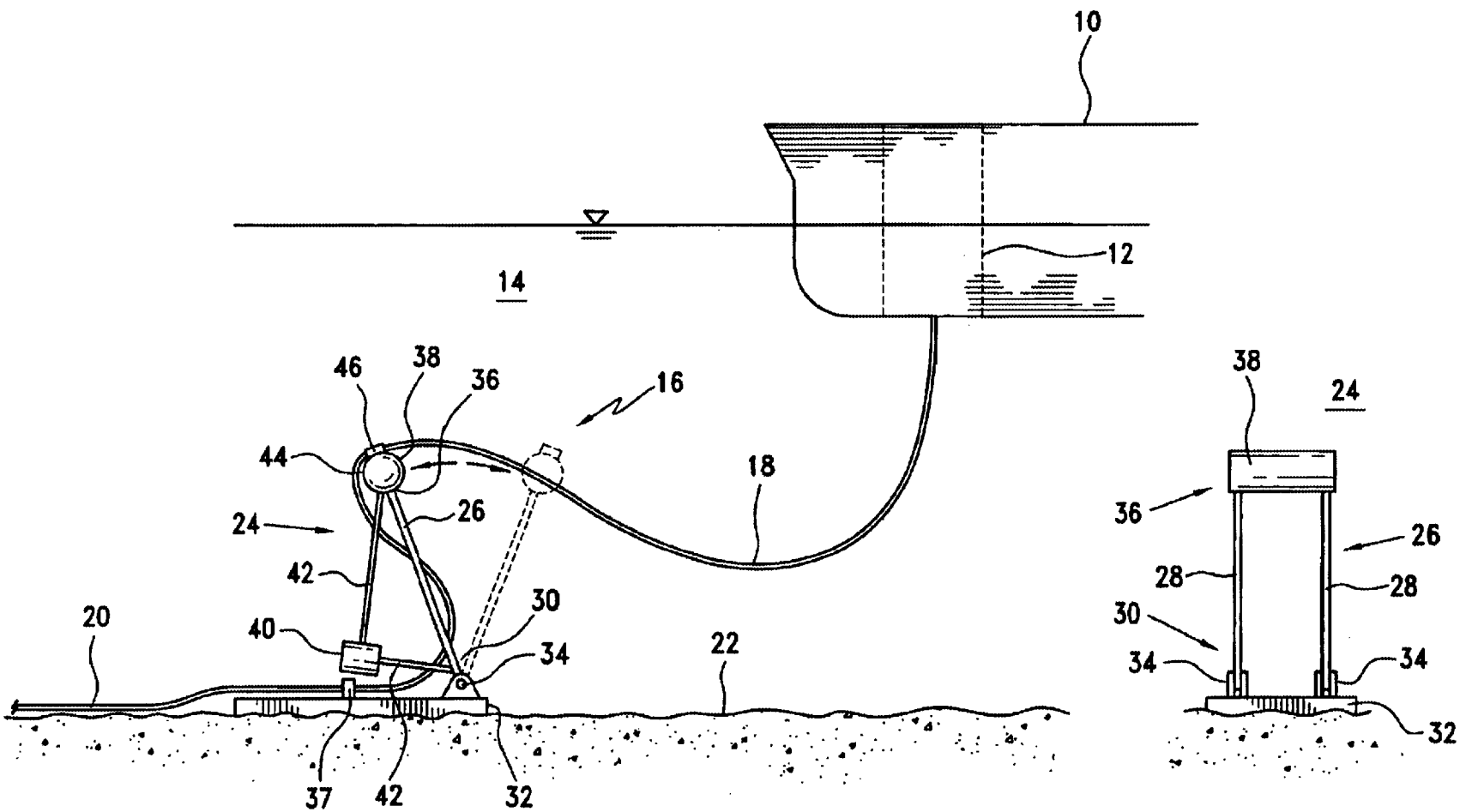
FIG. 1 is a side view of a riser system that employs a riser tensioning mechanism constructed in accordance with a first preferred embodiment of the present invention.
FIG. 2 is a front elevation of the tensioning mechanism employed in the riser system of FIG. 1.

Referring to FIGS. 1 and 2, a first preferred embodiment of the present invention is illustrated. A vessel 10 to be moored offshore is shown equipped with a single point mooring 12 and floating in a body of water 14. The single point mooring 12 is of known, conventional construction and the details thereof are not shown since they do not form an actual part of the present invention. The present invention comprises a riser system 16 that includes a flexible riser 18 for connecting a submerged flowline 20 on the seabed 22 to the vessel 10 for transfer of fluid between the flowline 20 and the vessel 10.

The key feature of the riser system 16 is a tensioning mechanism 24 that maintains tension on the riser 18 to avoid generation of excessive slack therein which could cause the riser 16 to be damaged from coming into contact either with the vessel 10 or the seabed 22. This enables the riser system 16 to be employed in shallow water applications where such systems cannot normally be employed. This is because even with a minimum riser length, the riser would very likely come into contact with the shallow seabed in a conventional system. In addition, in deep water applications, the tensioning mechanism 24 enables the riser length to be extended enough that the riser 18 can remain connected to the vessel 10, even during high wave and wind conditions that result in substantial movement of the vessel 10 and the mooring 12.

In the embodiment illustrated in FIGS. 1 and 2, the riser tensioning mechanism 24 comprises a tensioning element, which is preferably a rigid, u-shaped arm 26 that may be formed from any suitable rigid material, such as steel or another metal. As best illustrated in FIG. 2, the arm 26 includes a pair of legs 28, each of which is pivotally attached at a first, bottom end 30 of the arm 26 to a submerged base 32 by means of a corresponding one of pair of pivot connections 34. As a result, the u-shaped arm 26 is free to rotate about the pivot connections 34 in a pendulum like manner such that a second, free end 36 of the arm 26 can move along an arcuate path as illustrated by the dashed lines in FIG. 1. The pivot connections 34 include pivot bearings (not shown) as is conventional and these may be sealed units or may be water lubricated to avoid lubrication problems.

The base 32 rests on the seabed 22 and may be secured thereto using piles, gravity weights or other means known in the industry. In addition, the base 32 may also be used as a termination point for the fluid flowline 20 where the flowline is connected to the riser 18 by means of a connection 37.

To function, the tensioning mechanism 24 must include one or more elements for applying tension to the riser by biasing or urging the tensioning element or arm 26, and thus the riser 18, toward an equilibrium position. In the embodiment of FIGS. 1 and 2, two such elements are employed. These include a buoy or other buoyancy element 38 that is disposed at the second end 36 of the tensioning arm 26, and serves to apply a restoring force that urges the arm 26 toward a vertical position. The second means for applying tension to the riser 18 comprises a weight 40 that is attached to one side of the arm 26 by means of a plurality of additional rigid arm or similar supporting elements 42. A first of the supporting elements 42 extends from the first end 30 of the arm 26 to the weight 40, while a second of the supporting elements 42 extends from the weight 40 to the second end 36 of the arm 26. It should be understood that other arrangements are also possible for supporting the weight 40, including the use of a more or less of the supporting elements 42. Like the buoy 38, the weight 40 serves to apply a restoring force to the arm 26, thought this force urges the arm 26 toward one side of vertical. In addition, since the supporting elements 42 are rigid, they could serve the same purpose as legs 28 of the tensioning arm 26, in which case the legs 28 could be replaced by non-rigid elements, such as chains or ropes, for example.

Preferably, the buoy or other buoyancy element 38 has a curved outer surface 44 so that a portion of the flexible riser 18 can be wrapped around the curved outer surface 44 to minimize any likelihood that he riser 18 could be damaged by the tensioning arm or element 26. This portion of the riser 18 is preferably attached to the tensioning element 26 by any suitable means, such as a clamp arrangement 46 of any known type. Thus, the riser 18 passes over the outer surface 44 of the buoy 38 and then down to connect into the submerged flowline 20 on the seabed 22. Essentially, the clamp arrangement 46 prevents the riser 18 from slipping along the outer surface 44 of the buoy 38 and so fixes the riser 18 to the buoy 38.

Figure 3:
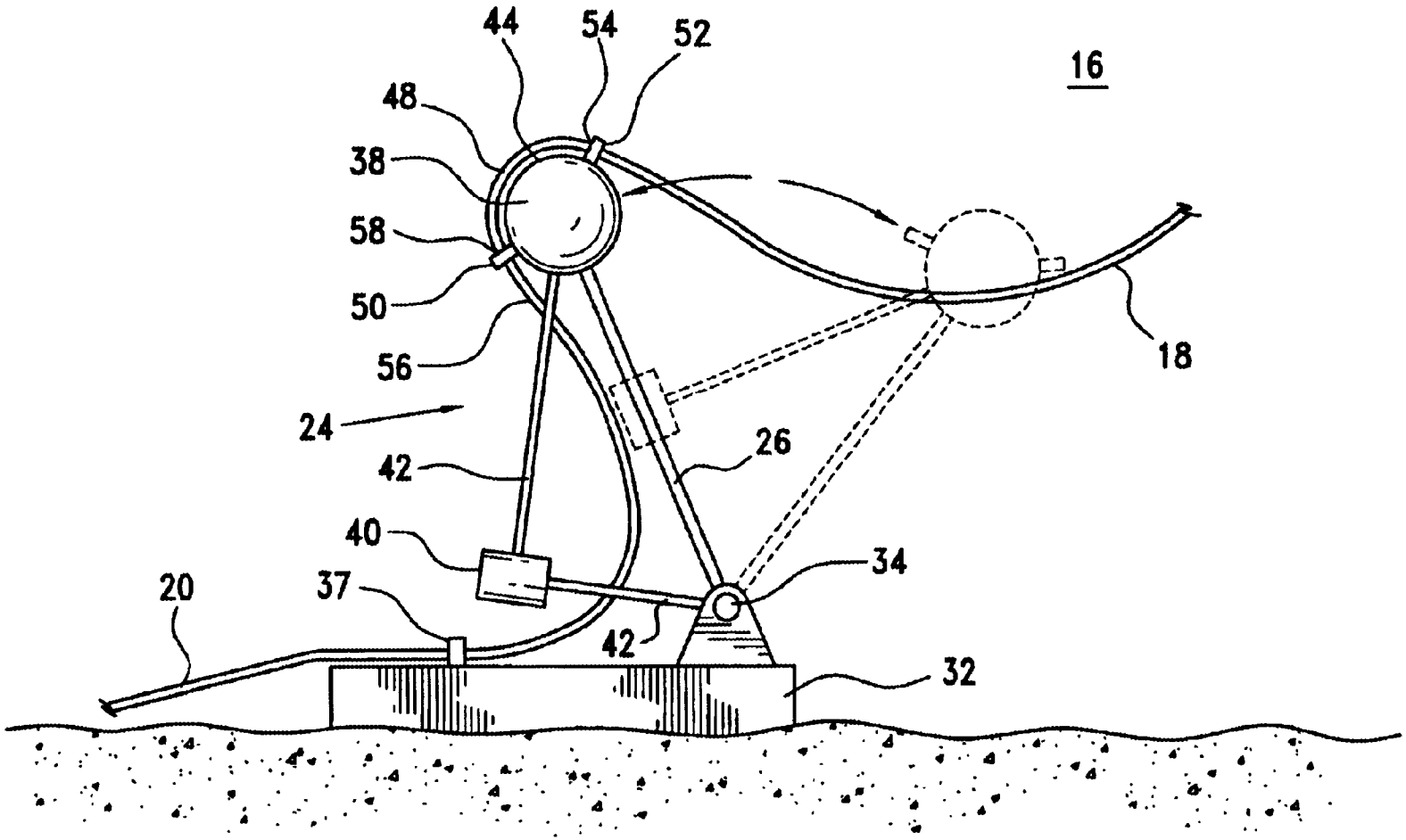
FIG. 3 is a side view of a variation of the riser tensioning mechanism employed in the riser system of FIG. 1 wherein a section of rigid tube is inserted in the riser to facilitate connection of the riser to the tensioning mechanism.

In the variation illustrated in FIG. 3, a short section of rigid pipe 48 is attached to the buoy 38 by means of first and second clamps 50 and 52 or other suitable attachment means. In this case, the riser 18 terminates and is connected at a first end 54 of the pipe 48. A second flexible riser 56 is connected to a second, lower end 58 of the pipe 48, which provides the required flexibility to allow the tensioning arm 26 to pivot. The rigid pipe 48 may also be extended to run down the arm 26 to some point near the pivot connections 34, thereby allowing the second flexible riser 56 to be made as short as possible.

Figure 4:
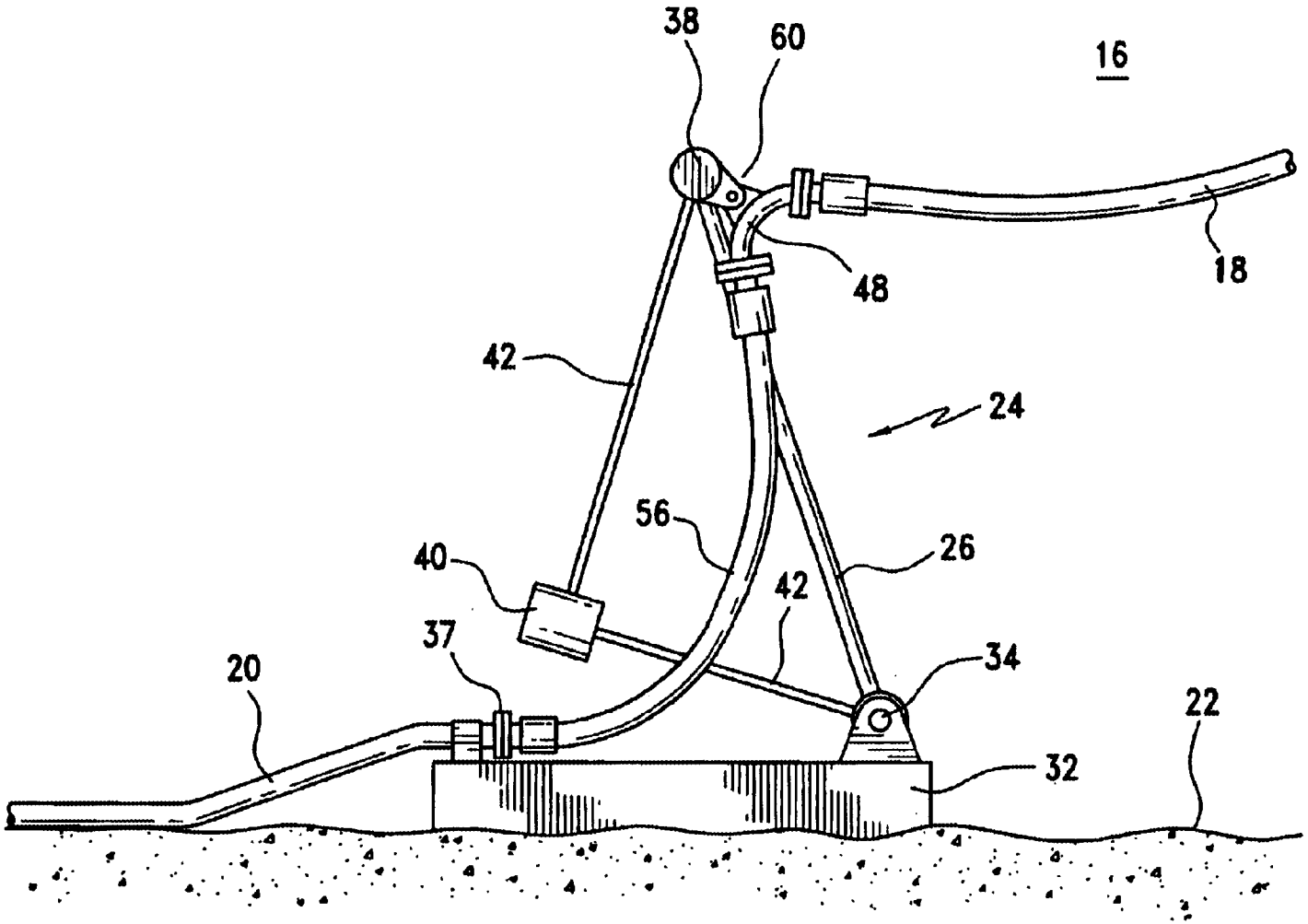
FIG. 4 is a side view of a riser system that employs a riser tensioning mechanism constructed in accordance with another preferred embodiment of the present invention in which a flexible riser is attached to a tensioning element by means of a pivot connection.

FIG. 4 illustrates another embodiment in which the short section of rigid pipe 48 is attached to the tensioning arm 26 by means of a second pivot connection 60 that allows the pipe 48 to rotate about the pivot point of the pivot connection 60. This arrangement allows greater flexibility of the attachment between the rigid pipe 48 and the arm 26 and aids in reducing loads in the risers 18 and 56.

In use, the riser tensioning mechanism 24 is at rest when it is in a position as illustrated in FIG. 1 that is to the left of vertical in which the restoring effects applied by the buoy 38 and the weight 40 are in balance with one another. When the vessel 10 moves away from the equilibrium position in response to wind or wave action, for example, the tension created in the riser 18 will pull on the tensioning arm 26, which will pivot around the pivot points of the pivot connections 34. As the buoy 38 and the arm 26 pivot, the weight 40 is also raised. The force of gravity upon the weight 40 causes a restoring effect and counters the tension on the riser 18 that is created by the movement of the vessel 10. In addition, when the arm 26 moves past the vertical position, the buoy 38 also begins to exert a vertical force due to its buoyancy. The vertical force produced by buoy 38 further exerts a restoring effect on the riser 18. By balancing the size of the weight 40 and the buoyancy characteristics of the buoy 38, varying degrees of resistance and responses to the dynamic loading can be achieved.

Figure 5:
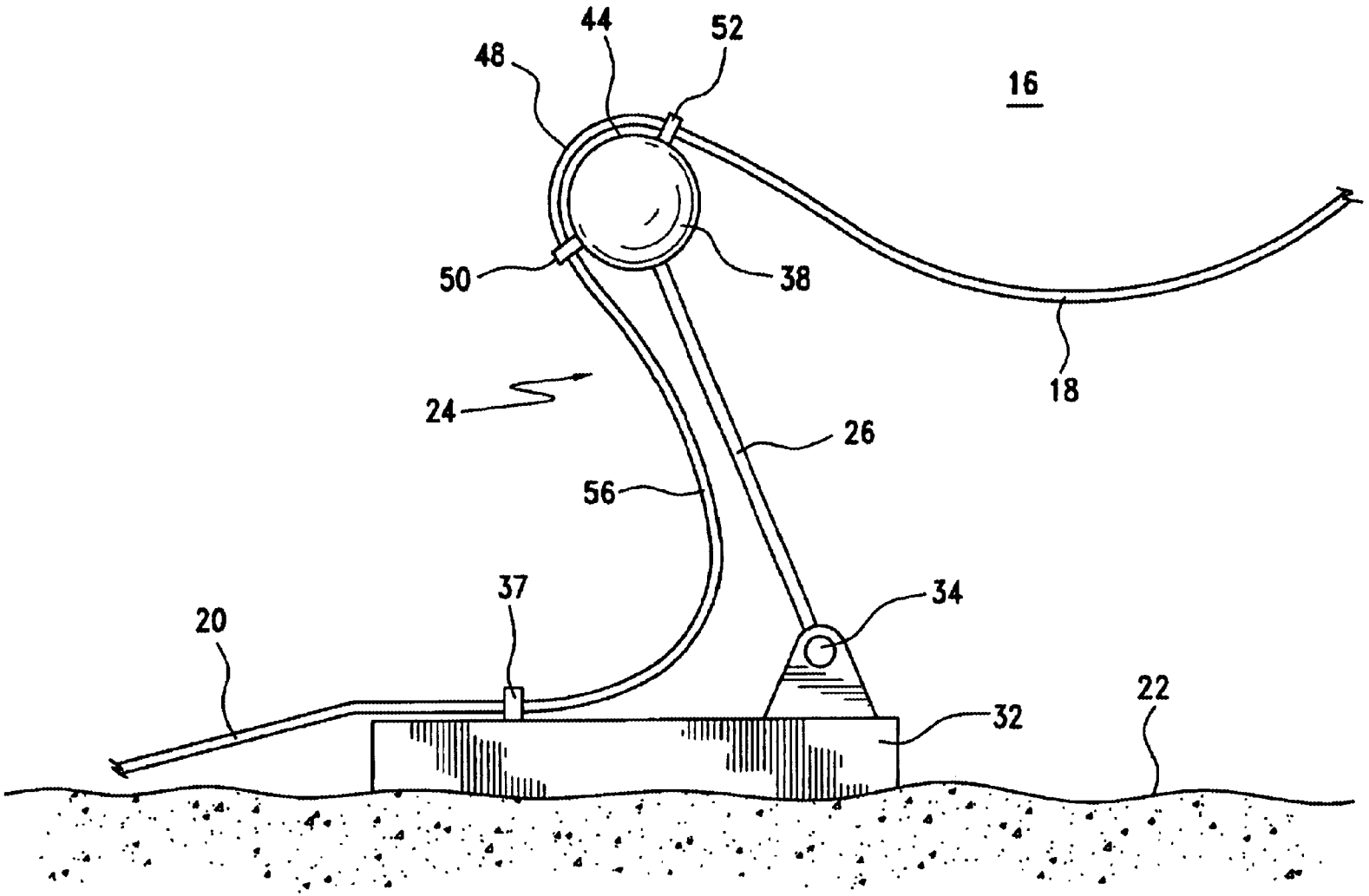
FIG. 5 is a side view of a riser system that employs a riser tensioning mechanism constructed in accordance with another preferred embodiment of the present invention in which a tensioning mechanism employs only a buoyancy element for applying tension to the riser.

It should be noted that while the embodiments of FIGS. 1–4 each employ both the buoy 38 and the weight 40, these tension-generating elements could also be used individually in some applications. For example, the weight 40 can be used without the buoy 38 either by removing the buoy 38 or by making the second end 36 of the arm 26 of a non-buoyant material in the case where the buoy 38 is formed integrally with the arm 26. In addition, another embodiment is illustrated in FIG. 5, which employs the buoy 38 without a weight and its supporting elements. It should also be understood that other types of tensioning applying means, such as springs, for example, could be used in place of or in addition to buoyancy elements and weights.

Various other modifications could also be made to the riser system 16. For example, the riser system 16 may include more than one of the tensioning mechanisms 24 so long as the tensioning arms 26 are attached to a pivot allowing for pendulum motion. Multiple riser systems 20 could also be used for a single vessel. Similarly, a riser system 16 could employ multiple ones of the risers 18.

In conclusion, the various embodiments of the riser system 16 thus have the advantage over previous systems used in that they each provide a greater degree of movement which allows the riser(s) to remain connected in extreme environmental conditions, while preventing the riser(s) from being damaged in normal conditions due to excessive slack that allows the riser(s) to come into contact with the vessel, sea bed or other submerged structures. The system thus finds particular advantage in shallow water applications where the likelihood of the riser(s) contacting the seabed is increased.

Although the present invention has been described in terms of a number of preferred embodiments and variations thereon, it will be understood that numerous additional variations and modifications may be made without departing from the scope of the invention. Thus, it is to be understood that within the scope of the appended claims, the invention may be practiced otherwise than as specifically described above.

What is claimed is:

1. A riser system for transporting fluid cargo from a sub sea facility to a vessel in a body of water comprising:

a flexible riser for transporting fluid cargo from a sub sea facility to a vessel; and a riser tensioning mechanism comprising:

a riser tensioning element having a first end and a second end;

a submerged base;

a pivot connection attached to said base and to said first end of said tensioning element for allowing said tensioning element to pivot about said base;

means for securing said riser to said second end of said tensioning element; and means for applying tension to said riser that urges said tensioning element toward an equilibrium position;

whereby, movement of said riser causes said riser tensioning element to move away from said equilibrium position and causes said means for applying tension to apply a counteracting force that urges said tensioning element back toward said equilibrium position, thereby maintaining tension on said riser, wherein said means for applying tension comprises one or more tension applying elements disposed on said tensioning element, said tension applying elements selected from the group comprising a buoy and a weight, wherein a buoy is disposed at said second end of said tensioning element and said riser is attached to said buoy, wherein said buoy has a curved outer surface and said riser is attached to said curved outer surface, wherein said system further includes a rigid section of pipe attached to said curved outer surface of said buoy and having a first end for attachment to a sub sea flow line and a second end attached to a first end of said flexible riser.

2. The riser system of claim 1 wherein said means for applying tension includes a weight attached to said tensioning element and positioned to urge said tensioning element to one side of vertical.

3. The riser system of claim 1, wherein said tensioning element comprises a rigid arm, wherein said rigid arm is a u-shaped arm having first and second vertical legs attached at first, bottom ends thereof to first and second corresponding pivot connections disposed on said submerged base.

4. The riser system of claim 3, wherein said buoy comprises a horizontally-positioned buoyancy element connecting second, top ends of said first and second legs together, whereby said buoyancy element urges said arm toward a vertical equilibrium position, thereby applying tension to said riser.

5. The riser system of claim 4, wherein said means for applying tension further includes a weight attached to one side of said u-shaped arm for urging said arm to one side of vertical.

6. A riser system for transporting fluid cargo from a sub sea facility to a vessel in a body of water comprising:

a flexible riser for transporting fluid cargo from a sub sea facility to a vessel; and a riser tensioning mechanism comprising:

a riser tensioning element having a first end and a second end;

a submerged base;

a pivot connection attached to said base and to said first end of said tensioning element for allowing said tensioning element to pivot about said base;

means far securing said riser to said second end of said tensioning element; and means for applying tension to said riser that urges said tensioning element toward an equilibrium position;

whereby, movement of said riser causes said riser tensioning element to move away from said equilibrium position and causes said means for applying tension to apply a counteracting force that urges said tensioning element back toward said equilibrium position, thereby maintaining tension on said riser;

wherein said tensioning element comprises a rigid arm;

wherein said arm is a u-shaped arm having first and second vertical legs attached at first, bottom ends thereof to first and second corresponding pivot connections disposed on said submerged base;

wherein said means for applying tension comprises a horizontally positioned buoyancy element connecting second, top ends of said first and second legs together;

whereby, said buoyancy element urges said tensioning arm toward a vertical position, thereby applying tension to said riser.

7. The riser system of claim 6, wherein said means for applying tension further includes a weight attached to one side of said u-shaped arm for urging said arm to one side of vertical.

8. The riser system of claim 6, wherein said buoyancy element has a curved outer surface and said riser is attached to said curved outer surface.

9. A riser system having a riser tensioning mechanism, said system comprising:

a base located on a seabed;

a rigid arm pivotally connected to said base by at least one pivot connection; said rigid arm extending upward from said base and being able to pivot in first and second, opposite directions away from a vertical position;

a buoyancy element attached to said rigid arm at a distance spaced from said pivot connection for urging said rigid arm toward said vertical position; and a flexible riser having a first end secured to said rigid arm at a distance spaced from said pivot connection and a second end secured to a vessel;

whereby said rigid arm is able pivot in said first direction in response to tension in said riser caused by movement of the vessel in said first direction, and whereby when the vessel moves in said second direction, opposite to said first direction, thereby creating slack in said riser, said buoyancy element urges said rigid arm back toward said vertical position to take up said slack in said riser.

10. The system of claim 9, further including a weight attached to one side of said rigid arm for urging said rigid arm to pivot away from vertical in said second direction to an equilibrium position, whereby said weight and said buoyancy element combine to urge said rigid arm toward said equilibrium position when taking up said slack in said riser.

11. The system of claim 9, wherein said riser is attached to said rigid arm via a pivotal attachment with said buoyancy element.

12. The system of claim 9 wherein said rigid arm is of a generally u-shaped configuration, having first and second vertical legs attached at first, bottom ends thereof to first and second corresponding pivot connections disposed on said base.

13. The system of claim 9, wherein said buoyancy element has a curved outer surface and said riser is attached to said rigid arm via attachment to said curved outer surface.

14. The system of claim 13, further including a rigid section of pipe attached to said curved outer surface of said buoy and having a first end for attachment to a sub sea flow line and a second end attached to said first end of said riser.

15. A riser system for transporting fluid cargo from a sub sea facility to a vessel in a body of water, said system comprising:

a base located on a seabed;

a rigid arm pivotally connected to said base by at least one pivot connection, said rigid arm extending upward from said base and being able to pivot in first and second, opposite directions away from an equilibrium position;

at least one tension-applying clement attached to said rigid arm at a distance spaced from said pivot connection for urging said arm toward said equilibrium position; and a flexible riser having a first end secured to said arm at a distance spaced from said pivot connection and a second end secured to a vessel;

whereby said rigid arm is able pivot in said first direction in response to tension in said riser caused by movement of the vessel in said first direction, and whereby when the vessel moves in said second direction, opposite to said first direction, thereby creating slack in said riser, said tension-applying element urges said rigid arm back toward said equilibrium position to take up said slack in said riser.

16. The system of claim 15, wherein said tension-applying element is a weight attached to one side of said arm for urging said arm to pivot in said second direction toward said equilibrium position.

17. The system of claim 16, further including a buoyancy element as one of said at least one tension-applying elements.

18. The system of claim 15, wherein said tension-applying element is a buoyancy element.

19. The system of claim 17, wherein said buoyancy element includes a curved outer surface and wherein said system further includes a rigid section of pipe attached to said curved outer surface of said buoyancy element, and having a first end for attachment to a sub sea flow line and a second end attached to said first end of said flexible riser.

20. The riser tensioning system of claim 16, wherein said riser is attached to said buoyancy element via a second pivot connection.

21. A riser system having a riser tensioning mechanism, said system comprising:

a base located on a seabed;

a rigid arm pivotally connected to said base by at least one pivot connection, said rigid arm extending upward from said base;

a buoyancy element attached to said rigid arm at a distance spaced from said pivot connection for urging said arm toward a vertical position;

a weight attached to said rigid arm to one side of vertical for urging said rigid arm toward an equilibrium position to one side of vertical; and a flexible riser having a first end secured to said buoyancy element and a second end secured to a vessel;

whereby said rigid arm is able pivot in a first direction away from said equilibrium position and past said vertical position in response to tension in said riser caused by movement of the vessel in said first direction, and whereby when the vessel moves in a second direction, opposite to said first direction, thereby creating slack in said riser, said buoyancy element and said weight urge said rigid arm back toward said equilibrium position to take up said slack in said riser.

22. The system of claim 21, wherein said rigid arm is a u-shaped arm having first and second vertical legs attached at first, bottom ends thereof to first and second corresponding pivot connections disposed on said submerged base.

23. The system of claim 21, wherein said buoyancy element includes a curved outer surface and wherein said system further includes a rigid section of pipe attached to said curved outer surface of said buoyancy element, and having a first end for attachment to a sub sea flow line and a second end attached to said first end of said flexible riser.

24. The riser tensioning system of claim 21, wherein said riser is attached to said buoyancy element via a pivotal attachment.

* * * * *